United States Patent [19]

Ulrich et al.

[11] 4,392,911

[45] Jul. 12, 1983

[54] APPARATUS FOR SEALING CARTONS

[75] Inventors: Lawrence W. Ulrich; Connie W. Walker, both of Bolingbrook, Ill.

[73] Assignee: Durable Packaging Corporation, Chicago, Ill.

[21] Appl. No.: 377,336

[22] Filed: May 12, 1982

[51] Int. Cl.[3] ..... B31F 1/00

[52] U.S. Cl. ..... 156/468; 53/137; 198/627; 198/726

[58] Field of Search ..... 53/137; 156/475, 468, 156/522; 198/726, 627

[56] References Cited

U.S. PATENT DOCUMENTS

| | | | |
|---|---|---|---|
| 2,648,450 | 8/1953 | Neal | 198/726 X |
| 2,910,205 | 10/1959 | Kvetschmer | 198/627 X |
| 3,595,369 | 7/1971 | Boulay et al. | 198/726 X |
| 4,044,527 | 8/1977 | Ulrich et al. | 53/137 |
| 4,161,138 | 7/1979 | Marchetti | 53/137 X |

*Primary Examiner*—David A. Simmons

*Attorney, Agent, or Firm*—Dressler, Goldsmith, Shore, Sutker & Milnamow, Ltd.

[57] ABSTRACT

An apparatus for sealing the foldable flaps of cartons. The apparatus includes an improved modular frame structure to support the sealing heads and the carton handling assemblies. The apparatus further includes an improved lift assembly to raise and lower the top sealing head assembly.

38 Claims, 8 Drawing Figures

Fig. 6.
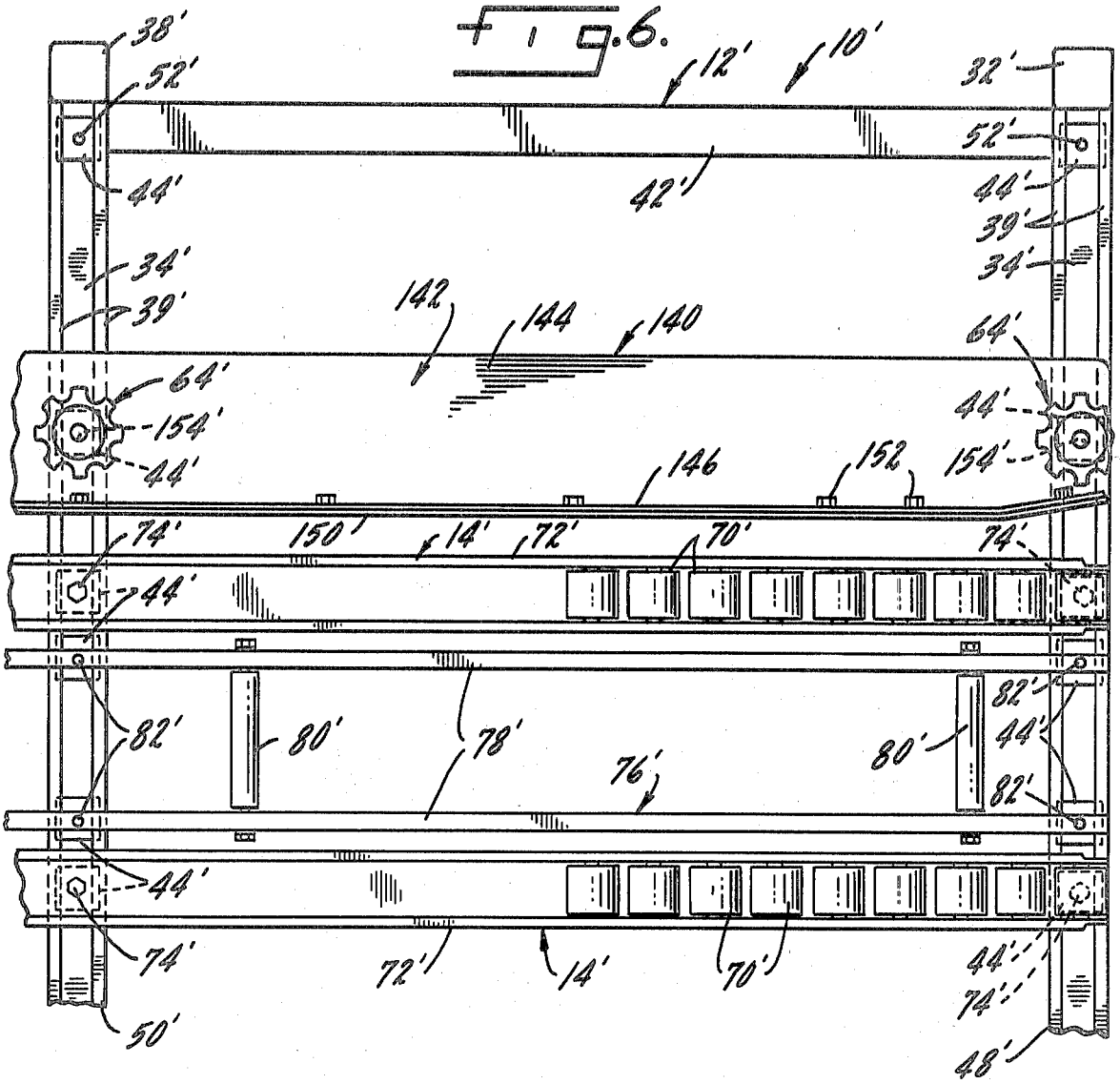
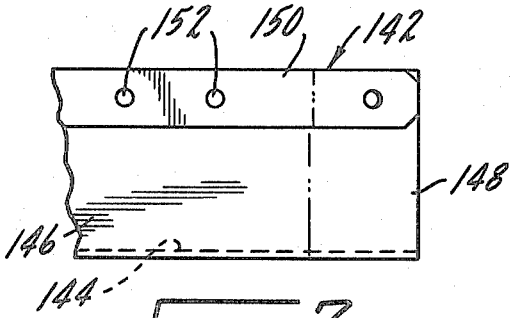
Fig. 7.
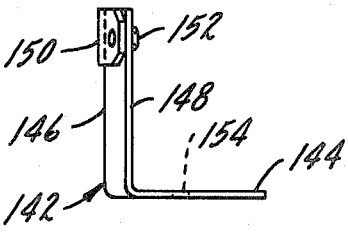
Fig. 8.

APPARATUS FOR SEALING CARTONS

BACKGROUND AND SUMMARY OF THE INVENTION

The present invention relates to apparatus for sealing the foldable flaps of cartons by applying a self-adhesive tape material along the edges of the flaps, and more particularly to an improved modular frame structure to support the sealing heads and the side arms assemblies, and an improved lift assembly to raise and lower the top sealing head assembly.

In the packaging industry, corrugated and fiberboard cartons have been used for many years and various machines have been developed which are capable of sealing such cartons either by glueing the flaps, taping the flaps, or by stapling or otherwise providing fasteners to maintain the flaps in a closed position. Many of these machines are designed to accept cartons of random width and height by providing various types of means to control the transverse movement of the side arm assemblies associated therewith and the vertical movement of the top head assembly. Examples of such machines are disclosed in U.S. Pat. Nos. 4,044,527, 4,079,577, and 4,173,105, having the same inventive entity and assignee as the present invention.

The frame structure in accordance with the invention defines a carton transporting and sealing bed which is vertically adjustable relative to the support legs. The frame structure further provides for modular receipt and support of the side arm assemblies, the bottom tape head support assembly, and the roller assemblies in a manner which facilitates transverse positioning thereof relative to the longitudinal center axis of the sealing machine.

The lift assembly in accordance with the invention includes a unique roller arrangement to raise and lower the top sealing head assembly. The lift assembly supports the top sealing head assembly in a manner which minimizes play in the support structure. Various means are provided in the lift assembly to adjust the relative positioning of the top sealing head assembly over the frame structure.

The frame structure and the lift assembly in accordance with the invention cooperate with one another to provide a machine which is versatile in operation and able to handle a wide range of applications.

BRIEF DESCRIPTION OF THE DRAWINGS

FIG. 6 is a partial top plan view, similar to FIG. 2, showing an alternative embodiment of the invention;

FIG. 7 is an elevational view of a portion of the guide bar assembly; and

FIG. 8 is an end view of the leading end of the guide bar assembly.

DESCRIPTION OF A PREFERRED EMBODIMENT

Figure 1:
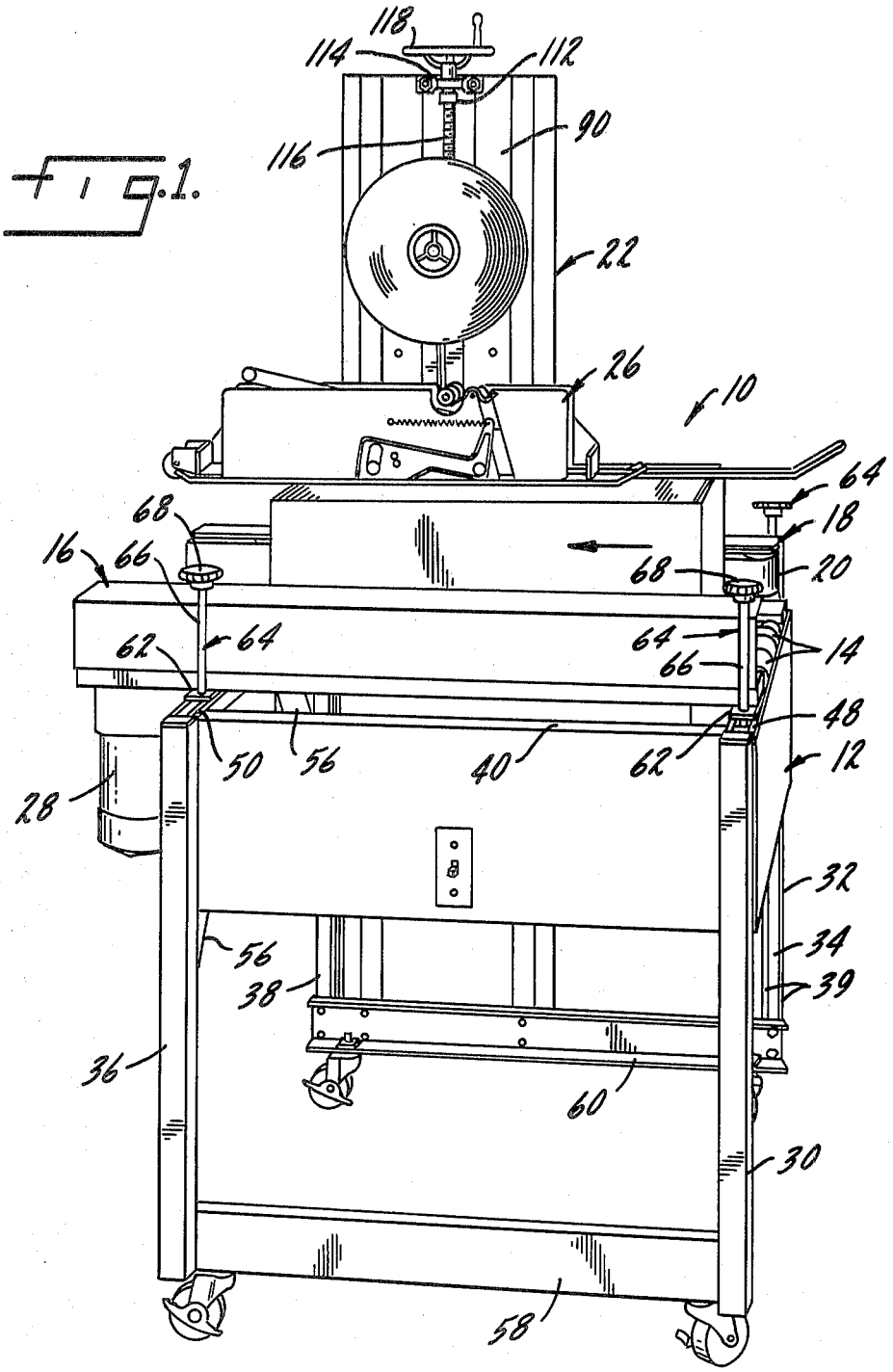
FIG. 1 is a perspective view of a carton sealing apparatus constructed in accordance with the present invention.

Referring now in detail to the drawings and in particular to FIG. 1, a carton sealing machine, incorporating the unique frame structure and lift assembly of the present invention, is indicated generally at 10. The brief discussion of carton sealing machine 10 which hereinbelow follows is for the purpose of generally disclosing a type of carton sealing apparatus which the present invention is contemplated for use. It being understood that the teachings of the present invention may be used in alternative types of carton sealing apparatus.

Carton sealing machine 10 includes a frame structure 12, which is constructed in accordance with the present invention, and will hereinbelow be described in greater detail. A plurality of transversely spaced carton conveying roller assemblies 14 are supported on frame 12. A pair of transversely spaced and longitudinally extending side arm assemblies 16 and 18 are mounted to frame 12 above rollers 14. The side arm assemblies 16 and 18 are mounted to frame 12 so as to permit transverse sliding movement towards and away from each other. Endless conveyor belts 20 (only one of which is shown) are journalled for rotation around roller members associated with the side arm assemblies 16 and 18. Extending vertically upward from frame 12 is a lift assembly 22. Lift assembly 22 is secured to a top tape head head assembly 26 and is effective to move the tape head assembly up and down above the frame 12. The specific construction of lift assembly 22 in accordance with the present invention will hereinbelow be discussed in greater detail. A motor 28 is in communication with one of the rollers (not shown) associated with each of the side arm assemblies 16 and 18 to drive the endless belts 20. Although not specifically illustrated, a bottom tape head assembly may be mounted to frame 12.

Briefly stated, the operation of carton sealing machine 10 is as follows. The elevation of the top tape head assembly 26 is adjusted to accommodate the height of the carton and the spacing between the side arm assemblies 16 and 18 is adjusted to accommodate the width of the carton. The carton is then fed into the entrance end of machine 10, in the direction of the arrow in FIG. 1, until the belts 20 contact the sides of the carton. The belts 20 remain in contact with the carton and move it past the tape head assembly 26 where a strip of sealing tape is applied across the top surfaces of the side flaps and the upper portions of the end side walls. The belts 20 continue to move the carton for delivery to an outlet conveyor (not shown) attached to the exit end of machine 10.

Figure 2:
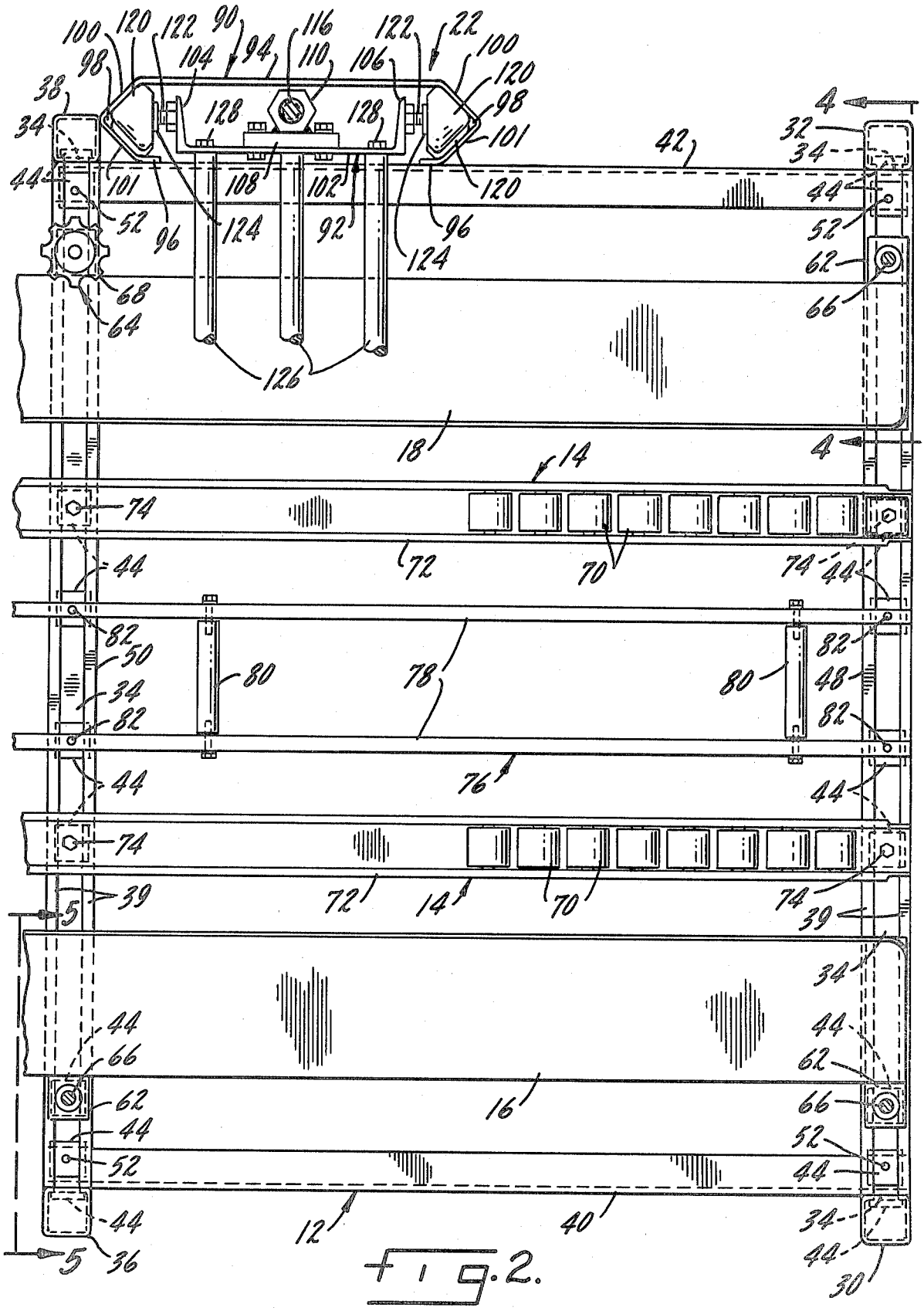
FIG. 2 is a top plan view of the entrance end of the apparatus shown in FIG. 1, partially broken away, with the top and bottom sealing heads removed to show details of the frame structure.

Referring to FIGS. 1, 2, 4, and 5, the frame structure 12 in accordance with the invention will now be described. Frame 12 includes a pair of generally vertical entrance leg members 30 and 32 which are positioned in a common transverse vertical plane. Front leg member 30 and rear leg member 32 are formed from hollow channel members having inwardly facing open channel portions 34 extending the entire length thereof. A pair of generally vertical exit leg members 36 and 38 are positioned in a common transverse vertical plane parallel to the plane through the leg members 30 and 32. Front leg member 36 and rear leg member 38 are of identical construction to leg members 30 and 32 and define therewith the corners of a rectangle when viewed in plan. As best seen in FIG. 2, the open channel portions 34 of the leg members are formed with turned in flanges 39, the significance of which will hereinbelow become more apparent.

Figure 4:
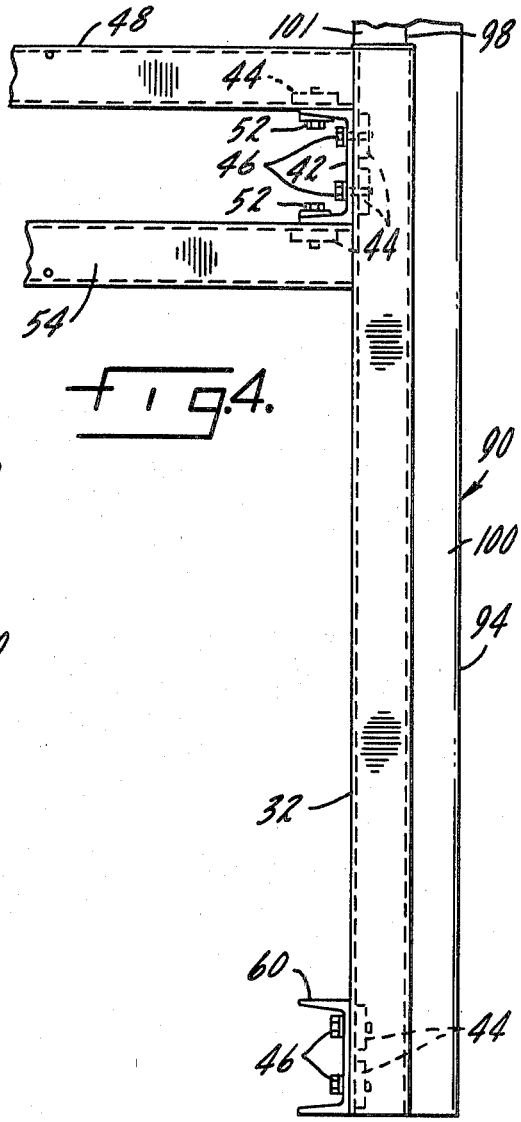
FIG. 4 is a partial view as viewed along line 4—4 in FIG. 2.
Figure 5:
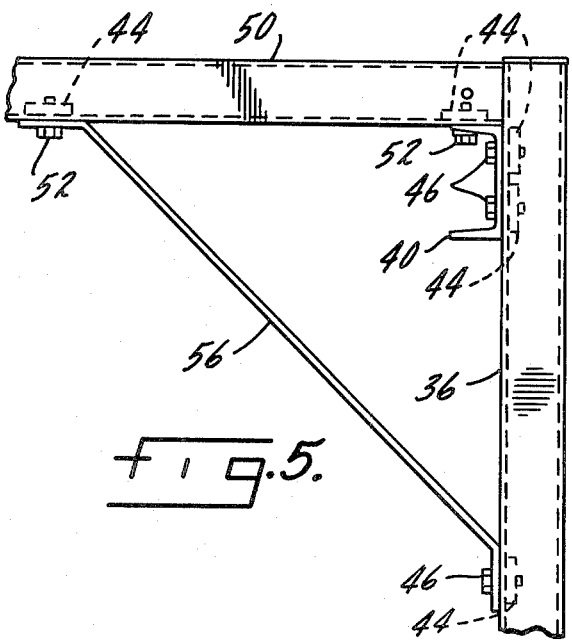
FIG. 5 is a partial view as viewed along line 5—5 in FIG. 2.

A longitudinally extending top front rail 40 extends between the upper portions of front legs 30 and 36 and a longitudinally extending top rear rail 42 extends between the upper portions of rear legs 32 and 38. As seen in FIGS. 4 and 5, rails 40 and 42 are of generally U-shape cross section having a pair of horizontal leg portions and a vertical base portion. The respective ends of the base portions of rails 40 and 42 extend across the respective channel portions 34 of the legs 30, 32, 36 and 38 and are connected thereto in a manner which permits selective vertical movement thereof relative to the legs. In essence, the rails 40 and 42 are clamped to the legs through a connecting arrangement which includes a pair of square plate members 44 which are received inside of the channel portions 34 and are selectively pressured against the inside surfaces of the flanges 39 by bolts 46 which extend through the base portion of the rails and the plate members 44. Upon loosening of bolts 46, the plates 44 are free to vertically move within the channel portions 34 and thereby permit selective vertical movement of the respective rails.

An entrance cross support member 48 extends between the entrance legs 30 and 32 and an exit cross support member 50 extends between the exit legs 36 and 38. Cross support members 48 and 50 are formed from channel members of similar construction to legs 30, 32, 34 and 36 and, accordingly, have upwardly facing channel portions 34 and flanges 39. The bottom portions of members 48 and 50 are secured to the corresponding upper horizontal legs of top front rail 40 and top rear rail 42 by suitable fastening means 52 extending therethrough. It is relatively apparent, that, upon loosening of the bolts 46, the rails 40 and 42 and the cross support members 48 and 50 are vertically movable as an integral unit, with the channel portions 34 of the legs serving as a guide.

As seen in FIG. 4, a second or lower entrance cross support member 54 extends between the entrance legs 30 and 32. Member 54 is of similar construction to member 48, however, the channel portion 34 thereof faces downwardly. Member 54 is secured to the lower horizontal legs of top front rail 40 and top rear rail 42 by fastening means 52. Accordingly, cross support member 54 is movable in unison with rails 40 and 42 and the cross support members 48 and 50.

A pair of brace members 56 (only one of which is shown) extend between intermediate portions of cross support member 50 and the respective legs 36 and 38. The braces 56 are fastened to the channel portions 34 of the legs 36 and 38 in a similar manner as rail 42 is secured to the legs. Accordingly, by loosening the bolts 46 associated therewith, the braces 56 are movable with the cross support member 50. A bottom front rail 58 extends between the lower portions of legs 30 and 36 and a bottom rear rail 60 extends between the lower portions of legs 32 and 38.

Referring to FIGS. 1 and 2, side arm assemblies 16 and 18 are supported on frame structure 12 immediately above entrance cross support member 48 and exit cross support member 40. The open channels 34 of these members serve as guides for the transverse movement of the side arm assemblies. Since each of the side arm assemblies 16 and 18 are of identical construction, the connection arrangement of side arm assembly 16 to frame 12 will only be herein described, it being understood that side arm assembly 18 is connected to frame 12 in a similar manner. Side arm assembly 16 is provided with a pair of plates 62 mounted to the undersurface thereof. Plates 62 are positioned with respect to the channel portions 34 associated with members 48 and 50 such that they extend across the entire width thereof. Plates 62 are slidably attached to members 48 and 50 in a similar manner as rails 40 and 42 are attached to the channel portions 34 of the legs. That is, a square plate member 44 is positioned in the channel portions 34 of members 48 and 50 immediately below each of the plates 62. A fastening assembly 64, associated with each of the plates 62, extends through the plate 62 and the corresponding plate member 44 to selective clamp the flanges 39 of the channel portion 34 between plate 62 and plate member 44. Fastening assembly 64 includes an upwardly extending shaft 66 which is rotatable by turning handle 68. The rotation of handle 68 is effective to selectively increase and decrease the clamping pressure between the plates 62 and 44 and the flange 39. Accordingly, upon loosening the fastening assemblies 64, the side arm assembly 16 is free to move transversely across frame 12 to a selected position, with the plates 44 in channel portions of members 48 and 50 serving as guides to control such transverse movement. Upon tightening of the fastening assemblies 64, the side arm assembly is rigidly retained in the selected position. Upon complete disengagement of the fastening assemblies 64, the side arm assembly may be completely removed from frame structure 12.

Carton conveying roller assemblies 14 are supported on frame structure 12 immediately above members 48 and 50 in a somewhat similar manner as side arm assemblies 16 and 18 are supported thereon. Roller assemblies 14 include a plurality of longitudinal spaced rollers 70 journalled for rotation in a channel member 72. Channel member 72 is secured to plate members 44 positioned within the channel portions of members 48 and 50 by fasteners 74. Upon selective loosening and tightening of fasteners 74, the assemblies 14 can be transversely positioned relative to members 48 and 50 and locked in place relative thereto. Thus, the roller assemblies 14 can be positioned relative to the width of the carton to be sealed. Upon complete disengagement of fasteners 74, the roller assemblies 14 can be completely removed from frame structure 12.

A carton support assembly 76 is also supported on frame structure 12 immediately above members 48 and 50 in a similar manner as the side arm assemblies 16 and 18 are supported thereon. Support assembly 76 includes a pair of spaced longitudinally extending rail members 78, which extend across the channel portions 34 of members 48 and 50. The rail members 78 are secured together by a pair of transversely extending connecting rods 80. Rail members 78 are secured to plate members 44 positioned within the channel portions of members 48 and 50 by fasteners 82. As with the roller assemblies 14, the carton support assembly 76 may be selectively removed from structure 12 or transversely positioned relative to members 48 and 50 and locked in place relative thereto. A bottom sealing head assembly (not shown) is suitably positioned within assembly 76.

As should already be apparent, the frame structure 12, constructed in accordance with the invention, cooperates with the various operative assemblies to provide a very flexible and simple carton sealing machine. The unique frame structure permits vertical adjustment of the operative assemblies which are secured to the bed formed thereby. Further, the operative assemblies which are supported thereon are readily movable in a transverse direction to permit the machine to perform various operations on a wide range of carton sizes.

Figure 3:
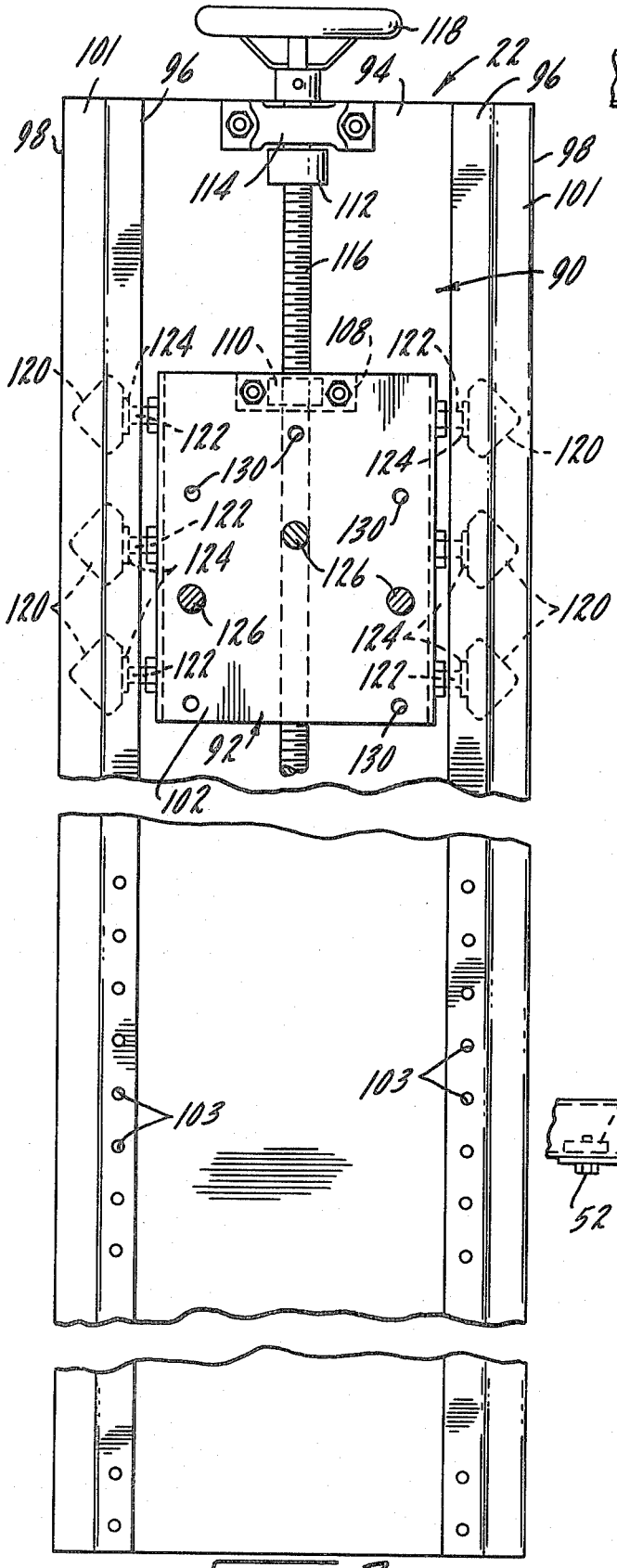
FIG. 3 is an elevational view of the lift assembly associated with the top sealing head assembly.

Referring to FIGS. 1, 2 and 3, the lift assembly 22, constructed in accordance with the present invention, will now be described with the requisite detail. Lift assembly 22 includes a lift guide member 90 and a lift channel member 92, which is vertically movable therein. Top tape head assembly 26 is mounted to lift channel member 92 and is movable therewith.

Lift guide member 90 is an elongated channel member having a closed rear portion 94 and an open front portion 96 in facing relationship to frame 12. As best seen in FIG. 2, member 90 is formed with a pair of longitudinal spaced end portions 98, which are of generally triangular cross section. End portions 98 are formed by the angular surfaces 100 and 101 which respectfully extend from portions 94 and 96 and intersect at generally right angles. The front portion 96 is formed with a plurality of vertically spaced openings 103 therethrough for releasable attachment of the guide member 90 to rails 42 and 60. By providing a plurality of such openings, the height of guide member 90 relative to the frame 12 is selectively adjustable.

Lift channel member 92 is positioned within guide member 90 for vertical movement therein. Member 92 is a generally U-shaped channel member having a base portion 102 in a plane parallel to the longitudinal center axis of frame 12 and in facing relation thereto. The leg portions 104 and 106 of member 92 are perpendicular to base portion 102 and extend inwardly into guide member 90. Referring to FIG. 2, a plate member 108 is mounted to the inside surface of base portion 102. A threaded nut 110 is welded to plate member 108 between leg portions 104 and 106. Referring to FIG. 3, a bearing member 112 is mounted to the upper inner surface of rear portion 94 of guide member 90 by a support bearing member 114. A threaded lift rod 116, positioned within guide member 90, is threadedly received about an intermediate portion through threaded sleeve 110. The upper portion of lift rod 116 is free of threads and extends through bearing 112. A handle member 118 is secured to the upper end of rod 116 for rotation thereof. It is quite apparent, that, the rotation of rod 116 is effective to raise and lower lift channel member 92 within lift guide member 90.

A unique feature of lift assembly 22 is the manner in which the movement of channel member 92 is guided within guide member 90 and maintained in a relatively rigid position therein free from play. This is attained by providing a plurality of roller members 120 which are supported by the leg portions 104 and 106 and travel in the end portions 98 of guide member 90. As best seen in FIG. 2, the roller members 120 are generally conical in shape to conform to the angular surfaces 100 and 101 of end portions 98. The roller members 120 are suitably journalled for rotation about stub shafts 122 which extend outwardly from the leg portions 104 and 106. In accordance with the invention, each of the leg portions 104 and 106 is provided with at least three roller members 120. The shafts 122 which support two of the roller members 120, preferably the uppermost and lowermost ones, are in a common vertical plane and the other shaft 122, which preferably supports a center roller member 120, is in a vertical plane spaced a short distance from the vertical plane passing through the other two roller members. Accordingly, the center roller member 120 is transversely offset from the other two roller members 120. The roller members 120 are biased outwardly into contact with the respective surfaces 100 and 101 of end portions 98, by a bellville washer 124 which is suitably positioned about shaft 122 in contact with roller member 120. As best seen in FIG. 2, the roller members 120 have a maximum diameter which is slightly less than the maximum transverse distance across the end portions 98. Thus, the upper and lower roller members 120 are in contact with the surfaces 100 of the end portions 98 and the middle roller member 120 is contact with the surfaces 101 of the end portions 98. The invention contemplates the use of more than three roller members 120 for travel in each end portion 98.

The top tape head assembly 26 is attached to channel member 92 through a plurality of support rods 126 which extend therebetween. As seen in FIGS. 2 and 3, in accordance with the preferred embodiment of the invention, three longitudinally spaced rods 126 are provided; the outer ones are in a common horizontal plane and the middle one is positioned a short distance above such plane. The rods 126 are releasably secured to channel member 92 by fasteners 128 which pass through openings 130 formed in base portion 102 and into the ends of the rods. As seen in FIG. 3, base portion 102 is formed with three series of openings 130 therein so as to permit vertical adjustment of the elevation of support rods 126 relative to channel member 92. This provides a means to adjust the maximum and minimum elevation of the top tape head assembly 26 relative to the frame 12. The other ends of rods 126 are similarly attached to assembly 26. It should be noted, that, by utilizing groups of rods 126 of longer or shorter length, the relative transverse positioning of assembly 26 may be selectively adjusted.

The lift assembly 22, constructed in accordance with the invention, provides a means to support the top tape head assembly 26 in a manner which permits maximum flexibility of the positioning thereof while providing a simple, reliable and play free mechanism for the selective vertical movement thereof.

In accordance with another feature of the invention, the frame structure 12 permits the modular manufacture and use of a carton sealing machine to meet a wide range of customer needs. A basic machine can be manufactured which includes a frame structure 12, a carton support assembly 76, a bottom tape sealing head (not shown) and a guide bar assembly 140 to guide the manual movement of the carton through the machine. Such a machine is shown in FIG. 6, and will be further described hereinbelow. To this basic machine, either during manufacture or subsequently by the customer, may be added various additional components in different combinations to increase the versatility or automation of the machine. For example, a side arm assembly 16 can be added in facing relationship to the guide bar assembly 140 to move the carton through the machine. One or more roller assemblies 14 can be added to facilitate the movement of the carton through the machine. A lift assembly 22 and top tape head assembly 26 can be added to seal the top flaps of the carton.

Referring to FIG. 6, a basic carton sealing machine is indicated generally at 10'. Since carton sealing machine 10' incorporates common structural assemblies to those disclosed with regard to machine 10 in FIGS. 1-5, a duplication of the disclosure of the structural details of these common assemblies will not be repeated, it being deemed sufficient to indicate such common assemblies and the elements associated therewith in FIG. 6 by the same reference numeral followed by a prime sign. Carton sealing machine 10' includes a frame structure 12', a carton support assembly 76', a bottom tape sealing head (not shown), and a guide bar assembly 140. Although not absolutely necessary, it is preferable that even a basic machine includes at least one roller assembly 14'.

Referring to FIGS. 6–8, guide bar assembly 140 includes a longitudinally extending angle plate 142 having a substantially horizontal leg portion 144 and a substantially vertical leg portion 146. The leading edge of vertical leg portion 146 is preferably bent inwardly, from the lower corner, as indicated at 148, to facilitate the entrance of the cartons. A longitudinally extending strip 150 is preferably secured at the upper edge of vertical portion 146 in facing relation to assembly 76'. Strip 150 is secured to vertical portion 146 by fastening means 152, which are recessed into strip 150. Strip 150 is made from a material which facilitates sliding movement of the carton thereagainst; such as teflon.

Guide bar assembly 140 is supported on frame structure 12' immediately above the entrance cross support member 48' and the exit cross support member 50'. The open channels 34' of these members serve as guides for the transverse movement of assembly 140. Guide bar assembly 140 is attached to frame structure 12' in a similar manner as side arm assemblies 16 and 18 are attached to frame structure 12, as discussed hereinabove. That is, a square plate member 44' is positioned in the channel portions 34' of members 48' and 50' and fastening assemblies 64' extend through an opening 154 in the leg portion 144 and the corresponding plate member 44', to selectively clamp the flanges 39' between leg portion 144 and the plate members 44'. The movement and removal of guide bar assembly 140 is identical to that disclosed above with regards to the side arm assemblies 16 and 18.

In operation, the guide bar assembly 140 serves as a means to position the carton as it is manually moved through machine 10' by an operator. By appropriately positioning guide bar assembly 140 relative to the tape sealing head, the operator can position the carton into contact with the leading edge 148 and move the carton through the machine.

At such time as it is desired to upgrade the machine 10', a side arm assembly 16 can be attached to frame 12' in facing relation to guide bar assembly 140 on the opposite side of assembly 76'. This will eliminate the necessity to manually feed the carton through machine 10'. Further, at such time as it is desired to include means to seal the top flaps of a carton, a lift assembly 22 and a top tape head assembly 26 can be attached to frame 12'. In essence, as will be appreciated by one skilled in the art, any number of combinations are possible to meet the requirements of a specific application. The design of frame structure 12 permits the manufacture of this unique modular carton sealing machine.

Various modifications are contemplated and may obviously be resorted to by those skilled in the art without departing from the spirit and scope of the invention, as hereinafter defined by the appended claims, as only a preferred embodiment has been disclosed.

What is claimed is:

1. Apparatus of the type used for sealing the foldable flaps of cartons; said apparatus including a frame structure, a sealing head assembly mounted to said frame structure, and at least one longitudinally extending side arm assembly mounted to said frame structure; said frame structure comprising: a pair of entrance leg members positioned in a common transverse vertical plane and a pair of exit leg members positioned in a common transverse vertical plane spaced from the plane of said entrance leg members, said entrance leg members and said exit leg members including a front leg member and a rear leg member; an entrance cross support member extending between the upper portions of said entrance leg members and an exit cross support member extending between the upper portions of said exit leg members, said entrance cross support member and said exit cross support member being formed with upwardly extending open channel portions; and means secured to said side arm assembly for slidable receipt within said channel portions of said entrance cross support member and said exit cross support member so as to permit selective transverse movement of said side arm assembly above said channel portions.

2. The invention as defined in claim 1 wherein said entrance leg members and said exit leg members are formed with inwardly facing open channel portions, a top front rail extends between the upper portions of said front leg members and a top rear rail extends between the upper portions of said rear leg members, said entrance cross support member and said exit cross support member are secured to said top front rail and said top rear rail, and means secured to said top front rail and said top rear rail for receipt within said channel portions of said leg members so as to permit selective vertical movement thereof relative thereto.

3. The invention as defined in claim 1 wherein said means secured to said side arm assembly includes locking means to selectively retain said side arm assembly in position on said entrance cross support member and said exit cross support member.

4. The invention as defined in claim 2 wherein a bottom rear rail member extends between the lower portions of said rear leg members and bottom front rail member extends between the lower portions of said front leg members.

5. The invention as defined in claim 1 wherein a carton support assembly extends between said entrance cross support member and said exit cross support member, and means secured to said carton support assembly for slidable receipt within said channel portions of said entrance cross support member and said exit cross support member so as to permit selective transverse movement thereof above said channel portions.

6. The invention as defined in claim 5 wherein said carton support assembly includes a pair of spaced longitudinally extending rails and a pair of spaced transversely extending members between said longitudinally extending rails, said sealing head assembly includes a bottom sealing head positioned between said longitudinally extending rails.

7. The invention as defined in claim 1 wherein at least one carton conveying roller assembly extends between said entrance cross support member and said exit cross support member and means secured to said carton conveying roller assembly for slidable receipt within said channel portions of said entrance cross support member and said exit cross support member so as to permit selective transverse movement thereof above said channel portions.

8. The invention as defined in claim 2 wherein said top front rail and said top rear rail respectively have a generally vertical surface and a generally horizontal surface, said entrance cross support member and said exit cross support member being secured to the horizontal surfaces of said top front rail and said top rear rail, and said means being secured to said vertical surfaces of said top front rail and said top rear rail.

9. The invention as defined in claim 8 wherein said top front rail and said top rear rail have a generally U-shaped cross section.

10. The invention as defined in claim 1 further including: a lift guide member secured to said frame assembly, said lift guide member being a channel member having an open side in facing relationship to said frame assembly and having a pair of longitudinally spaced end portions of generally triangular cross section; a lift channel member positioned within said lift guide member and movable vertically therein; a plurality of generally conically shaped roller members secured to said lift channel member for receipt within said end portions of said lift guide member; and connecting means for connecting said sealing head assembly to said lift channel member for support thereof over said frame assembly.

11. The invention as defined in claim 10 wherein the maximum diameter of said roller members is slightly less than the maximum transverse distance across said end portions.

12. The invention as defined in claim 11 wherein at least three of said roller members are provided in each of said end portions, with at least two of said roller members having an axis of rotation in a common vertical plane parallel to the longitudinal axis of said lift guide member and at least one of said roller members having an axis of rotation in a different vertical plane parallel thereto.

13. The invention as defined in claim 12 wherein said roller members are journalled for rotation about stub shafts secured to said lift channel member.

14. The invention as defined in claim 13 wherein said roller members have bias means associated therewith for biasing said roller members outwardly into contact with a surface of said end portions of said lift guide member.

15. The invention as defined in claim 13 wherein said lift channel member is a generally U-shaped member and said stub shafts are secured to the parallel leg portions thereof.

16. The invention as defined in claim 14 wherein said bias means is a bellville washer which is received around said stub shaft and in contact with said roller member.

17. The invention as defined in claim 10 wherein said sealing head assembly is secured to said lift channel member by a plurality of connecting rods of equal length which are releasably secured to said lift channel member and said sealing head assembly.

18. The invention as defined in claim 17 wherein said lift channel member is provided with a plurality of vertical spaced openings for receipt of said connecting rods in a manner which permits selective adjustment of the elevation of said sealing head assembly relative to said lift channel member.

19. The invention as defined in claim 10 wherein a threaded rod is rotably secured to said lift guide member and extends downwardly thereinto and said lift channel member is secured to said threaded rod such that rotation of said threaded rod is effective to raise and lower said lift channel member within said lift guide member.

20. The invention as defined in claim 19 wherein said threaded rod extends through a threaded member secured to said lift channel member.

21. Apparatus of the type used for sealing the foldable flaps of cartons; said apparatus including a frame structure, a sealing head assembly mounted to said frame structure, at least one longitudinally extending side arm assembly mounted to said frame structure; and an improved lift assembly for mounting said sealing head assembly to said frame structure, comprising: a lift guide member secured to said frame assembly, said lift guide member formed from a tubular member having an open side in facing relationship to said frame assembly and a pair of longitudinally spaced end portions of generally triangular cross section; a lift channel member positioned within said lift guide member and movable vertically therein; a plurality of generally conically shaped roller members secured to said lift channel member for receipt within said end portions of said lift guide member; and connecting means for connecting said sealing head assembly to said lift channel member for support thereof over said frame assembly.

22. The invention as defined in claim 21 wherein the maximum diameter of said roller members is slightly less than the maximum transverse distance across said end portions.

23. The invention as defined in claim 22 wherein at least three of said roller members are provided in each of said end portions, with at least two of said roller members having an axis of rotation in a common vertical plane and at least one of said roller members having an axis of rotation in a different vertical plane parallel thereto.

24. The invention as defined in claim 23 wherein said roller members are journalled for rotation about stub shafts secured to said lift channel member.

25. The invention as defined in claim 24 wherein said roller members have bias means associated therewith for biasing said roller members outwardly into contact with a surface of said end portions of said lift guide member.

26. The invention as defined in claim 24 wherein said lift channel member is a generally U-shaped member and said stub shafts are secured to the parallel leg portions thereof.

27. The invention as defined in claim 25 wherein said bias means is a bellville washer which is received around said stub shaft and in contact with said roller member.

28. The invention as defined in claim 21 wherein said sealing head assembly is secured to said lift channel member by a plurality of connecting rods of equal length which are releasably secured to said lift channel member and said top sealing head assembly.

29. The invention as defined in claim 28 wherein said lift channel member is provided with a plurality of vertically spaced opening for receipt of said connecting rods in a manner which permits selective adjustment of the elevation of said sealing head assembly relative to said lift channel member.

30. The invention as defined in claim 21 wherein a threaded rod is rotably secured to said lift guide member and extends downwardly thereinto and said lift channel member is secured to said threaded rod such that rotation of said threaded rod is effective to raise and lower said lift channel member within said lift guide member.

31. The invention as defined in claim 30 wherein said threaded rod extends through a threaded member secured to said lift channel member.

32. Apparatus of the type used for sealing the foldable flaps of cartons; said apparatus including a frame structure, a sealing head assembly mounted to said frame structure, and a longitudinally extending guide bar assembly attached to said frame structure; said frame structure comprising: a pair of entrance leg members positioned in a common transverse vertical plane and a pair of exit leg members positioned in a common transverse vertical plane spaced from the plane of said entrance leg members, said entrance leg members and said exit leg members including a front leg member and a rear leg member; an entrance cross support member extending between the upper portions of said entrance leg members and an exit cross support member extending between the upper portions of said exit leg members, said entrance cross support member and said exit cross support member being formed with upwardly extending open channel portions; and means secured to said guide bar assembly for slidable receipt within said channel portions of said entrance cross support member and said exit cross support member so as to permit selective transverse movement of said guide bar assembly above said channel portions.

33. The invention as defined in claim 32 wherein said guide bar assembly includes a longitudinally extending angle plate member having a generally horizontal leg portion and a generally vertical leg portion, said generally horizontal leg portion extends away from said sealing head assembly and has said means associated therewith.

34. The invention as defined in claim 32 wherein a strip is secured to a surface of said vertical leg portion in facing relation to said sealing head assembly.

35. The invention as defined in claim 34 wherein said strip is formed from a teflon material.

36. The invention as defined in claim 34 wherein the leading edge of said vertical leg portion is bent inwardly from the lower corner thereof.

37. The invention as defined in claim 33 wherein a side arm assembly is attached to said frame structure in facing relation to said guide bar assembly on the opposite side of said sealing head assembly.

38. The invention as defined in claim 33 wherein a lift assembly is secured to said frame structure for support of a tape head assembly above said frame structure.

* * * * *